United States Patent [19]

Manion et al.

[11] Patent Number: 4,907,513

[45] Date of Patent: Mar. 13, 1990

[54] HIGH VOLUME OBTURATOR ASSEMBLY METHOD

[75] Inventors: Michael C. Manion; Vernon C. Ralph, both of Hopkins, Minn.

[73] Assignee: Honeywell Inc., Minneapolis, Minn.

[21] Appl. No.: 195,322

[22] Filed: May 18, 1988

[51] Int. Cl.[4] ..... F42B 31/00; B32B 31/16

[52] U.S. Cl. ..... 102/527; 156/73.4; 156/293

[58] Field of Search ..... 29/1.2, 1.23; 156/73.1, 156/73.4, 293, 308.4; 24/16 PB; 102/524, 525, 526, 527, 439, 501, 517, 520–523; 277/220, 221, 222

[56] References Cited

U.S. PATENT DOCUMENTS

| | | | |
|---|---|---|---|
| 2,442,369 | 6/1948 | McBride . | |
| 2,759,778 | 8/1956 | Anderson | 277/220 |
| 2,928,348 | 3/1960 | Zisman et al. . | |
| 3,040,662 | 6/1962 | Zisman et al. . | |
| 3,687,079 | 8/1972 | Scollins | 102/524 |
| 3,760,736 | 9/1973 | Eig . | |
| 3,910,194 | 10/1975 | Dehm et al. . | |
| 3,973,064 | 8/1976 | Paine | 156/73.4 |
| 3,999,486 | 12/1976 | Bower . | |
| 4,187,783 | 12/1980 | Campoli et al. | 102/521 |
| 4,242,961 | 1/1981 | Moredock et al. . | |
| 4,268,559 | 5/1981 | Smuckler | 24/16 PB |
| 4,366,015 | 12/1982 | Murray . | |
| 4,381,319 | 4/1983 | Hargreaves et al. . | |
| 4,413,567 | 11/1983 | Frostig . | |
| 4,441,429 | 4/1984 | Price et al. . | |
| 4,446,795 | 5/1984 | Price et al. . | |
| 4,532,868 | 8/1985 | Glerchaut et al. . | |
| 4,552,071 | 11/1985 | Horars et al. . | |
| 4,558,646 | 12/1985 | Hoffmann et al. . | |
| 4,833,995 | 5/1989 | Gotz et al. | 102/524 |

OTHER PUBLICATIONS

"Silicones Improve Self-Lubricating Thermoplastics" by John E. Theberge, Machine Design 9-6-84, pp. 108–111.

*Primary Examiner*—Harold J. Tudor

*Attorney, Agent, or Firm*—Whitham & Marhoefer

[57] ABSTRACT

An obturating band of the despun variety is manufactured within the channel of a projectile assembly. A split ring polymer pre-band is clamped around the band seat of the projectile assembly and the free ends are welded together to form a continuous ring around the diameter of the projectile assembly within the encircling channel. One free end includes a male connector and the other free end includes an undersized female receptacle. Upon exposure to ultrasonic energy, the free ends are welded together at a scarf joint. A calculated amount of extra material which is present in the male connector is allows the joint to weld itself. The joining surfaces are positioned on indented sections of the free ends such that the resulting obturating band does not bulge at the joint. The obturating band is constructed to slip against the band seat and, therefore, is allowed to rotate at a rate independent of the underlying projectile.

7 Claims, 2 Drawing Sheets

FIG.2
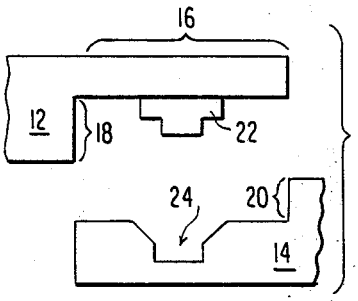
FIG.1
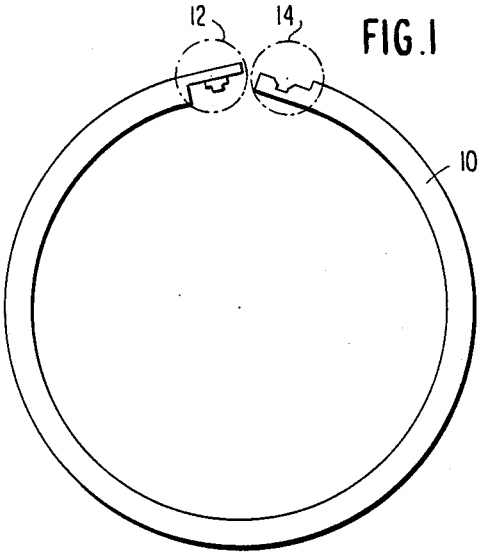
FIG.3
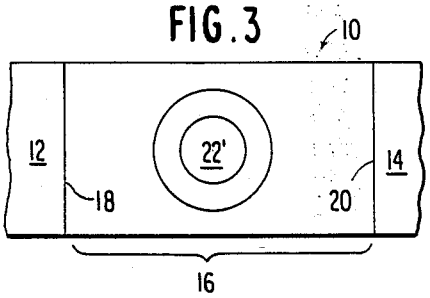
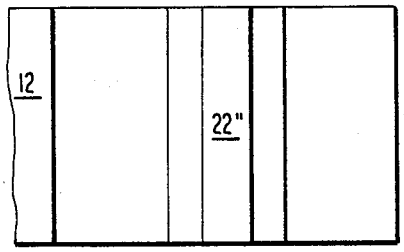
FIG.4
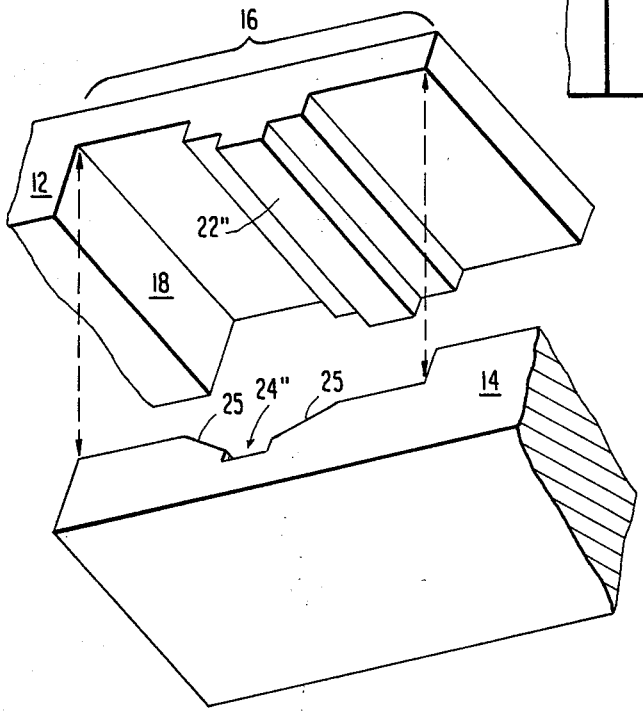
FIG.5

FIG.6a
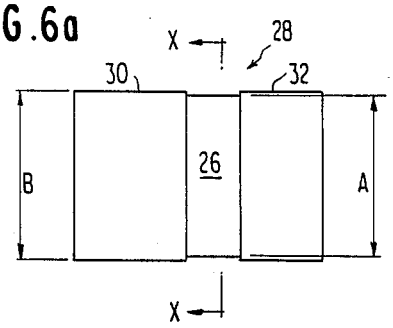
FIG.6b
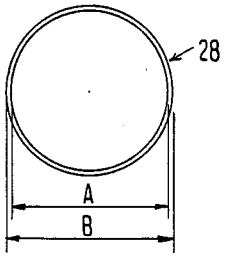
FIG.7a
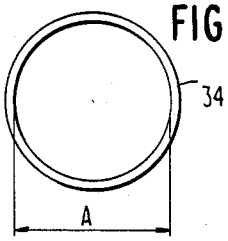
FIG.7b
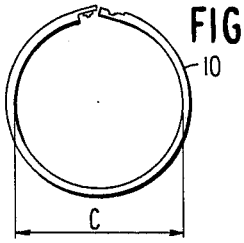
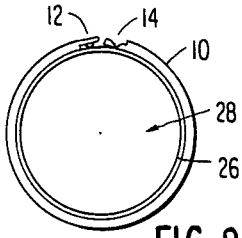
FIG.8
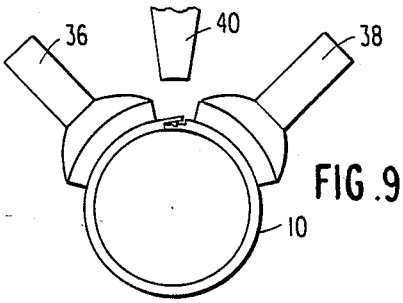
FIG.9a
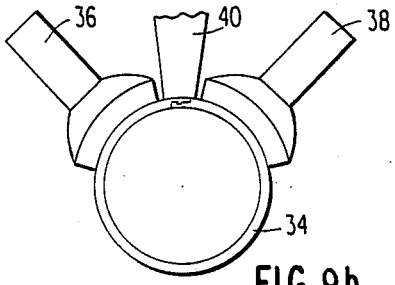
FIG.9b
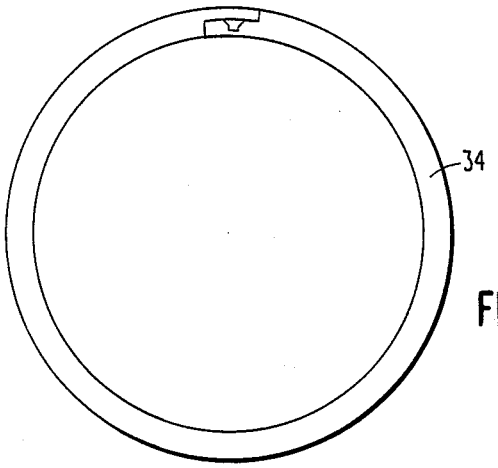
FIG.10

HIGH VOLUME OBTURATOR ASSEMBLY METHOD

CROSS-REFERENCE TO RELATED APPLICATIONS

The subject matter of the co-pending application Ser. No. 156858, filed Feb. 17, 1988, by M. C. Manion (Honeywell docket A211191) is related to this invention. That application and this application are assigned to a common assignee. The disclosure of application Ser. No. 156,858 is incorporated herein by reference.

BACKGROUND OF THE INVENTION

1. Field of the Invention

The present invention is generally related to obturating bands of the type that are rotated at a rate independent of the rate of rotation of the projectile and, more particularly, to a method of manufacturing an obturating band whereby the free ends of a split ring pre-band which is placed in a projectile band seat are welded together to form a continuous single piece band.

2. Description of the Prior Art

Obturators for smart projectiles are most often of the despun type wherein only a portion of the rotational velocity imposed on the obturator by contact with the rifling in the gun barrel during firing is passed on to the projectile. An inner surface of the obturator fits against and rotates on a mating surface in the projectile sidewall or sabot sidewall. The mating surface is ordinarily a channel formed around the perimeter of the projectile or sabot. Obturators made from naturally slippery nylon or similar materials slip against the projectile body within the channel. Silicone oil or other friction reducing additive can be placed between the mating surface of the projectile and the inner surface of the obturator to enhance the slipping. The gun barrel rifling contacts an outer surface of the obturator and causes the obturator to rotate very quickly as it traverses the length of the gun. The projectile is caused to rotate at a speed less than would be achieved by a direct coupled obturator since despun obturators are permitted to slip within the projectile channel. However, a sufficient rotational velocity is imparted to offset any thrust vector misalignments.

U.S. Pat. No. 4,242,961 to Moredock et al discloses a chevron grooved decoupling obturator wherein the interior of the obturator ring is designed to slip rotationally with respect to the projectile body as the projectile travels along the barrel. The decoupling obturator minimizes the rotation of the projectile to one tenth the spin rate that would ensue if a suitable decoupling means were not provided. The obturator is made of 127E nylon which is naturally slippery and usually does not require a lubricant. However, Moredock et al do make provisions for the addition of a lubricant in the small clearance area inside the obturator ring. The obturator is slipped over a threaded portion at the aft end of the projectile and held in a channel by securing a threaded aft closure.

U.S. Pat. No. 4,552,071 to Horais et al discloses a two-piece despin obturator comprised of a ring shaped body made from nylon-6 and a wiper band made from Plascon nylon. The spiral lands of the gun barrel impart a high rotational velocity to the obturator. The rotational velocity is only partially coupled to the projectile through the friction of the inner surface of the nylon obturator on the steel obturator mount.

Neither Moredock et al nor Horais et al show a method for placing a despun obturator in a band seat which is of smaller diameter than adjacent sections of the projectile or sabot where the band seat and adjacent sections are integral. Moredock et al specifically show slipping the band on a surface of the projectile and then attaching a threaded member behind the band to create a non-integral channel. The preferred method to manufacture projectiles or sabot sections includes forming an integral band seat in the form of a channel about the projectile or sabot perimeter. Forming an integral band seat channel requires less process steps than forming two pieces which are mated by a threaded section.

The prior art shows projectiles with obturating bands that have been assembled in an integral band seat channel of the projectile or sabot. U.S. Pat. No. 4,446,795 to Price et al and U.S. Pat. No. 4,381,319 to Hargeaves et al disclose processes in which the band seat zone is sprayed with a metallic coating and a polymer is molded over the sprayed metallic coating to form a plastic rotating band. U.S. Pat. No. 4,558,646 to Hoffmann et al discloses a projectile body with a rotating plastic band where the band is injection molded directly in the groove around the projectile diameter. U.S. Pat. No. 3,910,194 to Dehm et al discloses chemically bonding a rotating band by applying molten plastic to a heated projectile and then cooling the projectile.

None of the patents described above, wherein the rotating band is formed within the band seat channel by molding techniques, disclose a despun obturator as an end product. All of the patents form an obturating band which is bonded by some means to the projectile body. Hence, the obturating bands formed in the above-identified patents are directly coupled to the projectile and all of the spin imparted from the gun barrel rifling to the obturating band will therefore be transferred to the projectile body.

U.S. Pat. No. 4,532,868 to Gleichaut et al discloses a obturating band for projectiles that is positioned in an integral groove in the projectile and is held in place by a latching connection. The latch may have a dovetail or hook configuration which effectively prevents bursting open of the band under centrifugal force. However, this design prevents slippage between a rotating band and the body of the projectile as .well. Moreover, the resulting obturating band is not one continuous ring. The latch portion will have different properties from the rest of the band.

There is no teaching in the prior art of a obturating band in a band seat channel integrally formed about the perimeter of a projectile or sabot. There is no teaching in the prior art of a means for forming an obturating band starting with a split ring pre-band and forming a continuous ring using ultrasonic welding or heat staking technology wherein the resulting obturating band is of the despun variety and is formed within a band seat channel about the perimeter of a projectile or sabot.

SUMMARY OF THE INVENTION

It is therefore an object of this invention to provide a method of manufacturing a despun type obturator band.

It is another object of this invention to manufacture a despun type obturating band within an integral band seat channel about the periphery of a projectile or sabot.

It is yet another object of this invention to form an obturating band of uniform continuity starting with a split ring, polymer, pre-band wherein the free ends of the band are welded together with a scarf joint utilizing ultrasonic welding or heat staking technologies.

According to the invention, a polymer pre-band is injection molded or extruded in the shape of a "C" shaped open circle with free ends not touching or overlapping. One free end has an oversized male connector in the form of a two tier cylinder or linear bar. The other free end has an undersized female receptacle with angled walls leading to a matching cylindrical or corresponding linear base. The free ends of the pre-band are configured such that over a short length, the outer surface of the first free end and the inner surface of the second free end can be brought together and securely joined. Pre-bands are formed such that their size is matched to the diameter of the band seat in the projectile assembly in which the obturating band is to be used. The pre-bands may only be slightly larger than the diameter of the band seat in which they will be used, such that they will easily slip within the band seat. The pre-bands can be made from naturally slippery materials or be composed of a polyamide polymer and an interpenetrating polymer network comprised of silicone and polytetraflouroethylene as described in the co-pending application Ser. No. 156,858. The inside surface of the resulting obturating band has a reduced coefficient of friction which provides a slipping engagement with the underlying projectile.

In the assembly, the pre-band is fed into a fixture which holds the pre-band and slightly spreads the free ends apart. The projectile assembly, which may be either a projectile with an integral band seat or a sabot projectile with an integral band seat in the sabot, and pre-band are brought into alignment either obliquely or in parallel. The pre-band is aligned with the band seat in the projectile assembly and the free ends surround the majority of the circumference of the projectile assembly. The fixture then closes the free ends of the pre-band around the projectile assembly such that the configured joining surfaces come into contact. An ultrasonic welding machine or heat staking machine performs the actual joining procedure. Once the ends have been joined, the assembly is complete and the banded projectile is released from the assembly station.

A scarf joint is used to fasten the free ends together. There is a calculated amount of extra material in the joining members positioned on the free ends of the pre-band which allows the joint to make its own weld. As in a traditional scarf joint, the sharp corner created by the two tier male connector on the first free end attacks the undersized female receptacle on the second free end. Exposure to ultrasonic radiation at 20,000 cycles per second for a period of seconds causes the connectors on the free ends to melt and weld together. Heat staking technology may also be used to achieve the same result. The resulting band exhibits the continuity of an integral, unbroken, circular entity with an inside diameter appropriately sized to function in the specified diameter band seat of the projectile assembly. The obturating band formed is of the despun variety wherein slippage occurs between the inside diameter of the obturating band and the band seat.

BRIEF DESCRIPTION OF THE DRAWINGS

The foregoing and other objects, aspects and advantages of the invention will be better understood from the following detailed description of the preferred embodiment of the invention with reference to the accompanying drawings, in which:

FIG. 1 is a cross-sectional side view of a polymer pre-band showing the positions of the free ends after molding or extrusion;

FIG. 2 is a cross-sectional side view of a male connector and a female receptacle positioned at the free ends of the pre-band;

FIG. 3 is a plan view of the polymer pre-band showing the relative position of a cylindrical male connector within the width of the band and showing the relative position of the overlapping portions of the free ends of the pre-band when the cylindrical male connector is placed within the female receptacle;

FIG. 4 is a plan view of the male connector end of an extruded pre-band having a two tier linear bar;

FIG. 5 is an isometric perspective view of a linear bar male connector and a corresponding female receptacle positioned at the free ends of a pre-band;

FIGS. *6a* and *6b* are a side view and a cross-sectional end view taken along line X—X of a projectile assembly, respectively, showing that the diameter of the band seat is smaller than the adjacent, integral, sections of the projectile assembly;

FIGS. *7a* and *7b* are cross-sectional side views of a solid ring obturating band and a split ring pre-band, respectively, showing that the inside diameter of the solid ring obturating band which is to be formed is smaller than the inside diameter of the extruded pre-band;

FIG. 8 is a cross-sectional side view of the pre-band properly aligned within the band seat of the projectile assembly;

FIGS. *9a* and *9b* are cross-sectional side views of a pre-band being welded by an ultrasonic horn; and FIG. 10 is a cross-sectional side view of an obturating band which has been formed by welding the free ends of a pre-band together.

DETAILED DESCRIPTION OF THE PREFERRED EMBODIMENT OF THE INVENTION

Referring now to the drawings and, more particularly to FIG. 1, a polymer pre-band 10 is manufactured by molding or extrusion methods. The polymer pre-band 10 is composed of a naturally slippery material such as poly(hexamethyleneadipamide) or poly(imino-hexamethyleneiminododecanedioyl) which are known as Nylon 66® and Nylong 612®, respectively, or a similar material which has comparable welding properties. A lubricated polymer band as described in the cross-referenced co-pending application, Ser. No. 156,858, (Honeywell docket A211191) may be used wherein the band is composed of a polyamide polymer with an interpenetrating polymer network comprised of silicone and polytetraflourethylene. The interpenetrating polymer network reduces the coefficient of friction at the inside surface of the obturating band such that it may freely slip within the band seat of a projectile assembly. The polymer pre-band 10 has a first free end 12 with a male connector and a second free end 14 with a female receptacle.

FIG. 2 shows that the first free end 12 and second free end 14 are designed to overlap a short distance 16. Indentations 18 and 20 in the first and second free ends 12 and 14 permit the overlap for the short distance 16 to occur without bulging when the male connector 22 is welded inside the female receptacle 24. A scarf joint results from welding the male connector 22 to the female receptacle 24. The sharp corners of the two tier male connector 22 will attack the undersized female receptacle 24 during the welding step wherein a calculated amount of material present in the male and female connectors allow the scarf joint to make its own weld. Other standard designs of scarf joints can be utilized within the practice of this invention.

FIG. 3 shows a first embodiment of the invention wherein male connector 22' is a two tiered cylinder which is positioned in the center of the polymer pre-band 10 relative to the width. Indentations 18 and 20 define the short distance 16 of overlap of the first free end 12 relative to the second free end 14. The two tiered cylindrical male connector 22' is positioned in the center of the overlap section 16 and is aligned with the female receptacle (not shown) in the second free end 14.

FIGS. 4 and 5 show a second embodiment of the invention wherein male connector 22" is a two tiered linear bar which extends across the width of the polymer pre-band 10. The first free end 12 and second free end 14 overlap a short distance 16 with the two tiered linear bar male connector 22" being positioned in the center of the overlap section 16. The female receptacle 24" has angular side wall portions 25 which are attacked by the sharp corners of the two tiered linear bar male connector 24" during the welding step. There is a calculated amount of material present which permits the scarf joint to form its own weld.

FIG. *6a* shows a band seat 26 in a projectile assembly 28. The projectile assembly 28 may either be a projectile with an integral band seat or a sabot projectile with an integral band seat in the sabot. The band seat 26 and its adjacent sections 30 and 32 are integrally formed in the projectile assembly 28. The diameter A of the band seat 26 is smaller than the diameter B of the adjacent sections 30 and 32. FIG. *6b* is an end view of the projectile assembly 28 which emphasizes diameter B being larger than diameter A.

FIG. *7a* shows that the inside diameter of the obturating band 34 to be formed is equal to or just slightly greater than diameter A. Therefore, an obturating band 34 may not simply be placed in the band seat 26 of the projectile assembly 28 by sliding the obturating band in parallel because the diameter B of the adjacent sections 30 and 32 would block the progress of obturating band 34. The obturating band 34 can not simply be stretched over the adjacent sections 30 and 32 and placed in the band seat 26 because physical stresses caused by stretching the obturating band 34 would disrupt the integrity of the band. Moreover, if the material in the obturating band 34 creeps, the band will not spring back to the planned final diameter and the adjacent sections 30 and 32 will not retain the band.

The band seat 26 and adjacent sections 30 and 32 define a channel in the projectile assembly 28 which serves the function of retaining the obturating band 34 at a specific position along the length of the projectile assembly 28. FIG. *7b* shows that the molded or extruded pre-band 10 which is used to make the obturating band 34 has an inside diameter C which is larger than both diameters A or B. Hence, the polymer pre-band 10 can easily be slid over the adjacent sections 30 or 32 and placed in the within the band seat 26.

FIG. 8 shows a polymer pre-band 10 which has been placed in the band seat 26 of a projectile assembly 28. Positioning the polymer pre-band 10 includes the steps of feeding the polymer pre-band 10 into a fixture which holds the pre-band 10 and slightly spreads the free ends 12 and 14 apart. The projectile assembly 28 and polymer pre-band 10 are brought into position either obliquely or in parallel. In either case, the final location is such that polymer pre-band 10 is aligned with the band seat 26 of the projectile assembly 28 and the free ends 12 and 14 surround the majority of the circumference of the projectile.

FIG. *9a* shows that pressure pads 36 and 38 close the free ends of the pre-band 10 around the projectile assembly such that the configured joining surfaces, in this case the male connector and female receptacle, come into contact. An ultrasonic horn 40 is positioned between the pressure pads and above the overlapping section. FIG. *9b* shows that the horn 40 is pressed down on the overlapping section to expose the joining surfaces to ultrasonic energy. Exposure to 20,000 cycles per second for one second or more causes the free ends to weld together, thus forming obturating band 34. Heat staking technology can similarly be used to form an obturating band wherein a male connector is caused to weld within a female receptacle to form a welded scarf joint. Instead of exposure to an ultrasonic horn 40, a hot implement is pressed against the overlapping free ends similar to the horn 40 being pressed against the overlapping sections shown in FIG. *9b*, thus welding the free ends together to form a continuous ring.

FIG. 10 shows that obturating band 34 is effectively a solid, unbroken, circular entity. The physical and mechanical properties of the polymer of which the band is composed are not degraded due to irrecoverable mechanical distortion or environmental alteration. The inside diameter of obturating band 34 is controlled to mate with the band seat, thereby being retained in the channel about the perimeter of the projectile assembly. The obturating band thus formed is designed to slip against the band seat and is capable of rotating independently of the rate of rotation of the underlying projectile. The process described uses fully automatable, high volume production technologies.

While the invention has been described in terms of the preferred embodiment which includes a scarf joint formed between a two tier cylindrical male connector and a female receptacle, those skilled in the art will recognize that other configurations of the joining surfaces may be substituted in the practice of the invention within the spirit and scope of the appended claims.

Having thus described our invention, what we claim as novel and desire to secure by letters patent is the following:

1. A method of manufacturing a despun type obturating band for a projectile assembly, comprising the steps of:

forming a polymer pre-band including a male connector on a first free end and a female receptacle on a second free end, said first free end and said second free end being formed to allow for an overlapping section, said male connector being oversized for said female receptacle;

positioning said polymer pre-band in alignment with a band seat in said projectile assembly;

closing said polymer pre-band within said band seat such that said male connector is in alignment with said female receptacle; and welding said first free end and said second free end together whereby a continuous ring obturating band is formed.

2. A method of manufacturing a despun type obturating band as recited in claim 1 wherein said forming step provides for the formation of a scarf joint.

3. A method of manufacturing a despun type obturating band as recited in claim 2 wherein said welding step comprises the steps of:

placing an ultrasonic horn against said overlapping section; and exposing said overlapping section to sufficient ultrasonic energy to cause said male connector to weld within said female receptacle.

4. A method of manufacturing a despun type obturating band as recited in claim 2 wherein said welding step comprises the steps of:

placing a heated implement against said overlapping section; and exposing said overlapping section to sufficient heat to cause said male connector to weld within said female receptacle.

5. A polymeric pre-band for forming a despun type obturating band within a channel around the circumference of a projectile assembly, comprising:

a "C" shaped open ring having first and second free ends;

a two tiered male connector integrally formed on a first indented section on said first free end, a first tier of said two tiered male connector having a smaller crosssectional area than a second tier of said two tiered male connector, said second tier being positioned between said first tier and said first indented section; and a female receptacle created in a second indented section on said second free end, said two tiered male connector being oversized for said female receptacle, whereby a scarf joint is formed upon welding said two tiered male connector to said female receptacle.

6. A pre-band as recited in claim 5 wherein said two tiered male connector comprises a first cylinder positioned on a second cylinder wherein the diameter of said first cylinder is smaller than the diameter of said second cylinder.

7. A pre-band as recited in claim 5 wherein said two tiered male connector comprises a first rectangular bar positioned on a second rectangular bar wherein the crosssectional area of said first rectangular bar is smaller than the cross-sectional area of said second rectangular bar.

* * * * *